United States Patent [19]

Burns

[11] 4,080,761

[45] Mar. 28, 1978

[54] CONTROL VALVE ASSEMBLY

[75] Inventor: Albert L. Burns, Houston, Tex.

[73] Assignee: Bowen Tools, Inc.

[21] Appl. No.: 757,880

[22] Filed: Jan. 10, 1977

[51] Int. Cl.[2] ..... B24C 7/00

[52] U.S. Cl. ..... 51/438; 239/570

[58] Field of Search ..... 51/438; 239/412, 570; 251/60, 62

[56] References Cited

U.S. PATENT DOCUMENTS

| | | | |
|---|---|---|---|
| Re. 21,275 | 11/1939 | Pletcher | 51/438 |
| 509,992 | 12/1893 | Wood | 251/62 X |
| 2,608,801 | 9/1952 | Ridley | 51/438 |
| 3,102,368 | 9/1963 | Smith | 51/438 |
| 3,359,024 | 12/1967 | Morgan | 51/438 X |
| 3,970,280 | 7/1976 | Kunz | 251/62 X |

FOREIGN PATENT DOCUMENTS

| | | | |
|---|---|---|---|
| 112,668 | 1/1918 | United Kingdom | 51/438 |

*Primary Examiner*—Gary L. Smith

*Attorney, Agent, or Firm*—Pravel, Wilson & Gambrell

[57] ABSTRACT

A control valve assembly for regulating the mixing of abrasive from a pressurized tank with high pressure fluid during abrasive blasting operations having a tubular abrasive flow pipe and an abrasive control nozzle within a control valve housing, with provisions for moving the abrasive control nozzle and the tubular abrasive flow pipe relative to each other to and from an abrasive fluid mixing position from and to a sealed, closed position, respectively.

14 Claims, 6 Drawing Figures

CONTROL VALVE ASSEMBLY

BACKGROUND OF THE INVENTION

The field of this invention is control valves, particularly of the type used for mixing abrasive particles with high pressure fluid for abrasive blasting operations.

Abrasive blasting systems have long been and are well known in the art, such as generally disclosed in U.S. Pat. Nos. 3,834,082 and 3,543,444. Typically, such systems require some mechanism for introducing an abrasive from a reservoir into a high pressure fluid line to provide such abrasive particles under high pressure remote from the abrasive reservoir. Some systems utilized a valving structure wherein the flow of sand entering the high pressure fluid source is regulated by a sliding valve adjacent the base of the abrasive reservoir, such as shown in U.S. Pat. No. 3,182,425 or British Pat. No. 1,394,483, or using a gate-type valve as used with the Clemco Model FSV "Sand Miser Control Valve" as manufactured by the Clemco Manufacturing Company, or having a rotatable blocking valve element as shown in U.S. Pat. No. 3,476,440.

In U.S. Pat. No. 3,618,263, a pinchtype valve is used wherein high pressure fluid flow is regulated by adjusting the amount of air flow through the abrasive line rather than the metering of the abrasive by "pinching" the line closed. However, problems with the pinch-type valve systems include difficulty in obtaining complete shut off of abrasive and/or fluid as well as having high abrasive wear adjacent the valve point with a consequent short life span of the abrasive line adjacent thereto.

U.S. Pat. No. 3,924,657 discloses the use of a opposed-piston arrangement mixing valve whereas in U.S. Pat. No. 3,557,498, a rotatable valving plate is incorporated for controlling mixing of the abrasive and high pressure fluid. The prior art as far as known, has further encountered problems due to abrasives plugging up the valving structure with such abrasives becoming lodged therein. Many prior art devices not only require complete system shut downs to cure this defect but also may require complete disassembly of the control valve to remove such foreign particles.

The prior art also includes an abrasive mixing system wherein a closed pressurized tank having abrasive particles therein mixes with high pressure fluid adjacent a nozzle, directing the same upwardly through a stand pipe through the center portion of the abrasive tank with air bleeding outwardly from the stand pipe for further pressurizing the abrasive tank. Pressurized fluid within the stand pipe mixes with the abrasive and the fluid-entrained abrasive is directed outwardly from the top of the pressurized tank for use downstream in abrasive blasting operations. However, such prior art systems require depressurizing the tank, hence the entire system for cut off of the fluid-entrained abrasive flow while further requiring fill-time to repressurize the tank and system. Furthermore, such systems are not practical for multiple user operations as any user can deactivate the entire system by "dumping" the abrasive tank pressure. Further, all operators must have their remote control system in an "on" position for such a unit to operate properly. Additionally, failure of any component of such a system would result in shutting down all operations thereof.

SUMMARY OF THE INVENTION

The present invention relates to a new and improved control valve assembly for regulating the mixing of abrasive with high pressure fluid for abrasive blasting operations, having a control valve housing with a mixing chamber therein and a tubular abrasive flow pipe mounted therewith, an abrasive control nozzle disposed within the abrasive flow pipe, and means for moving the abrasive control nozzle and the tubular abrasive flow pipe relative to each other to and from an open abrasive fluid mixing position from and to a sealed, closed position, respectively.

DESCRIPTION OF THE PREFERRED EMBODIMENT

Figures 1, 2:
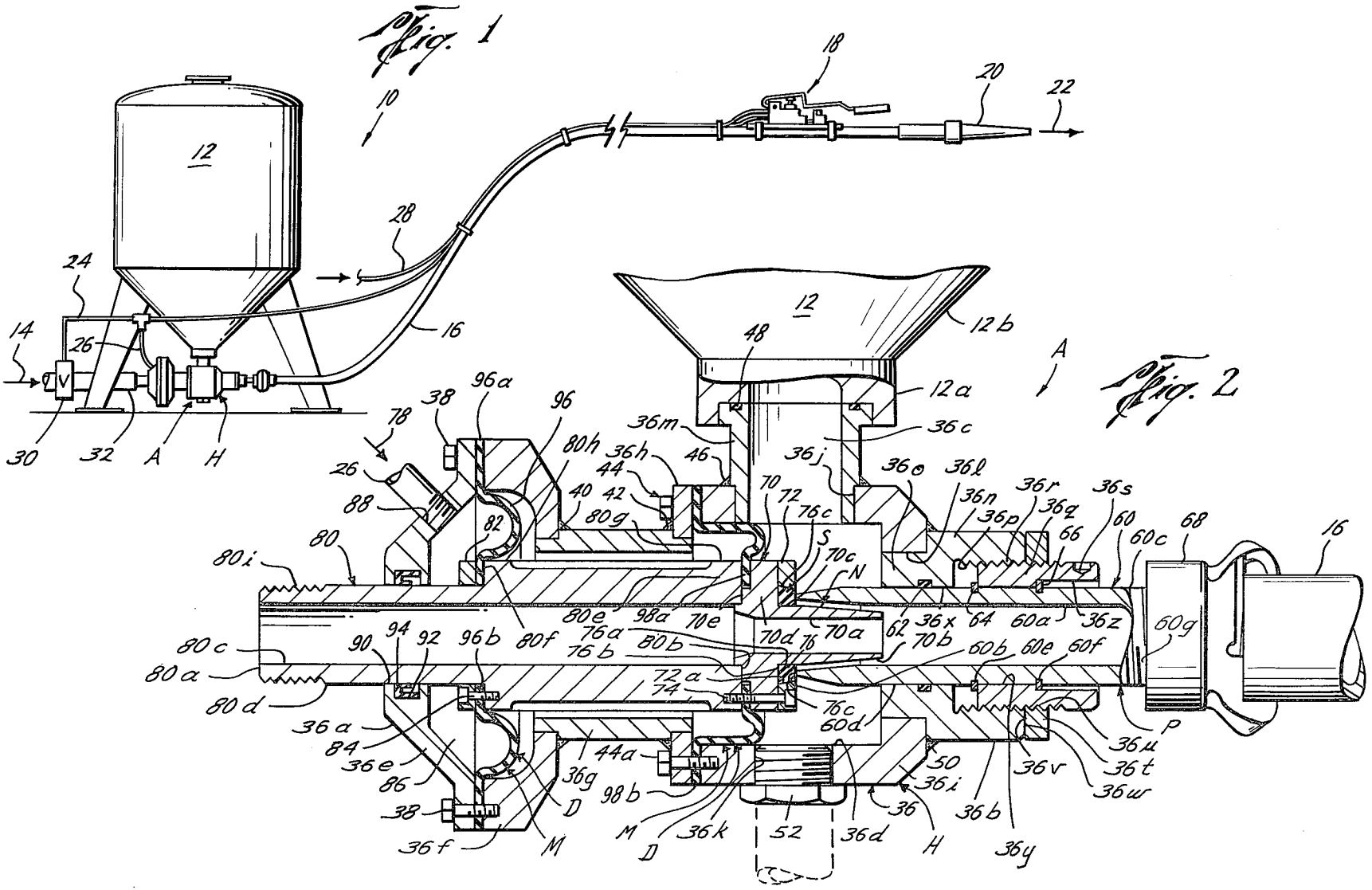
FIG. 1 is an elevation of the control valve assembly of the present invention with an abrasive blasting system.
FIG. 2 is a sectional view, partly in elevation, of the first embodiment of the control valve assembly of the present invention, in a closed position.
Figure 2A:
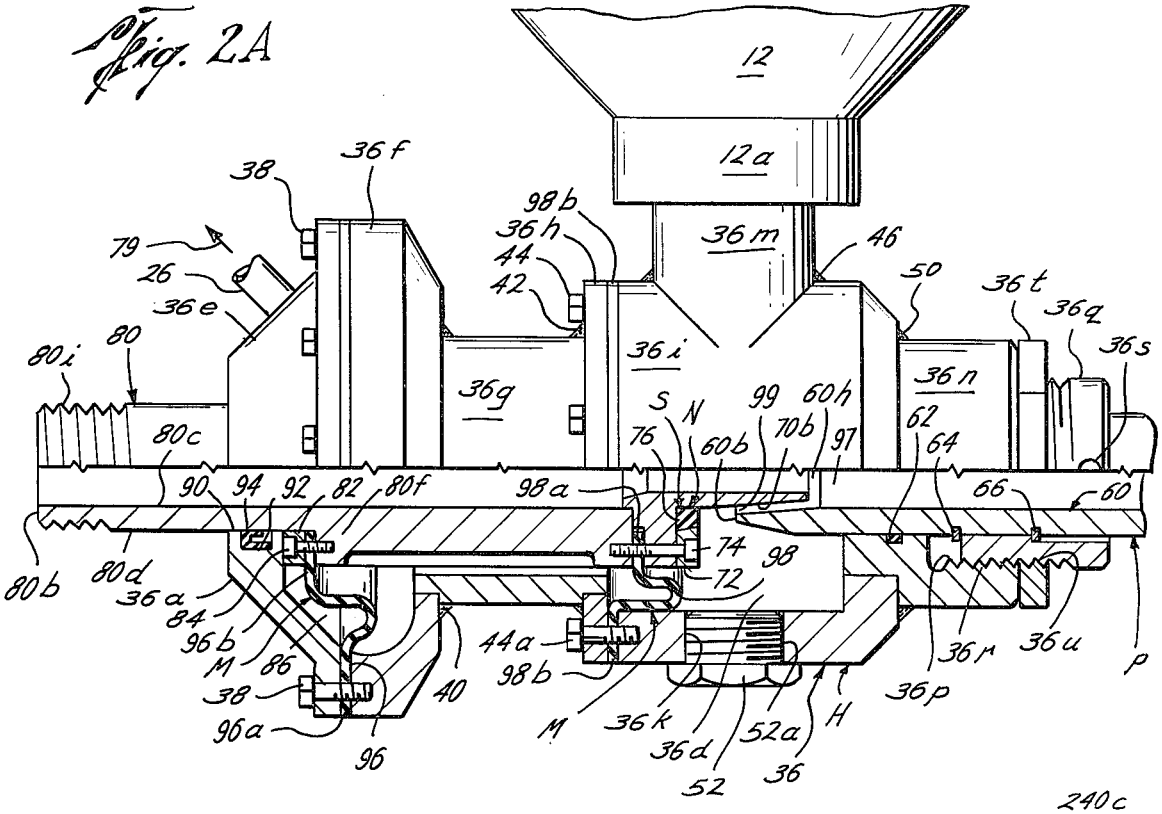
FIG. 2A is a sectional view, partly in elevation, of the control valve assembly of FIG. 1 in an open position.

Referring to the drawings, the letter A designates generally the control valve assembly of one embodiment of this invention which is illustrated in FIGS. 2 and 2A. The control valve assembly A includes a control valve housing H, a tubular abrasive flow pipe P, an abrasive control nozzle N, moving means M and seal means S. Unless otherwise noted, the components of this invention are preferably made of steel or other high-strength materials capable of taking abrasive-wear as well as high stresses and strains typical for pressurized systems.

As shown in FIG. 1, the control valve assembly A of the present invention is adapted to be used with an abrasive blasting system 10 which is commonly utilized to clean or otherwise treat surfaces of building stone, brick work, metal castings, and the like. Such abrasive blasting system 10 typically includes an abrasive reservoir, which may or may not be pressurized, but preferably includes large pressurized tank 12 for holding abrasive particles such as sand, glass beads or the like. Further, the system includes a source of high pressure fluid (not shown) for providing high pressure fluid, such as air, entering the system in the direction of arrow 14 which is adapted to be mixed with abrasive particles in the control valve assembly A of the present invention and directed outwardly therefrom into a tubular conduit such as high pressure abrasive hose 16. Typically, the tubular conduit or abrasive hose 16 may be quite long to enable the operator to get into places too small for the pressurized tank 12 to fit into or enable the operator to cover large working areas without requiring the constant movement of the pressurized tank 12.

A remote control valve 18 may be mounted adjacent the end of the tubular conduit or abrasive hose 16, which terminates with outlet nozzle 20 which directs the high pressure fluid-entrained abrasive outwardly thereof in the direction of arrow 22. The remote control valve 18 may be of the "dead man" type of remote control valve wherein the manually operative mechanism in the remote control valve 18 is biased in such a manner that in order to operate the control valve assembly A of the present invention, the operator must maintain the mechanism in a certain position, and upon the release thereof, it returns to its "off" position for deactivating the abrasive blasting system 10. Fluid control lines 24, 26, 28 communicate with metering valve 30, control valve assembly A of the present invention, and remote control valve 18 for control of the abrasive blasting system 10 as described more fully hereinbelow.

As shown in FIGS. 2 and 2A, the control valve assembly A of the present invention includes a control valve housing H. The control valve housing H includes housing 36 having a fluid inlet end portion **36*a* and a discharge outlet end portion 36*b*. An abrasive inlet 36*c* is formed between the fluid inlet end portion 36*a* and discharge outlet end portion 36*b*. A mixing chamber 36*d* is formed within the housing 36 in communication with abrasive inlet 36*c***.

The fluid inlet end portion **36*a* includes end plate 36*e*, flange plate 36*f* and tubular member 36*g*. End plate 36*e* is affixed to flange plate 36*f* by suitable fasteners 38, such as bolts, screws or the like and flange plate 36*f* is preferably rigidly affixed to tubular member 36*g* by weldment 40. Outer diaphragm flange 36*h* is mounted with the tubular member 36*g* by weldment 42 adjacent the end opposing the flange plate 36*f*. Outer diaphragm flange 36*h* is affixed to central body member 36*i* by fasteners 44 such as bolt 44*a*** or the like.

The central body member **36*i* is formed having the mixing chamber 36*d* therein. The central body member 36*i* has a top opening 36*j*, a bottom opening 36*k* and a side opening 36*l*, all in communication with and adjacent to the mixing chamber 36*d*. Abrasive inlet member 36*m* is mounted with the top opening 36*j* of central body member 36*i* by weldments 46 with the abrasive inlet member 36*m* having the abrasive inlet 36*c* formed therein and communicating with the mixing chamber 36*d*. The abrasive inlet member 36*m* is adapted to be mounted with the neck portion 12*a* adjacent the lowermost end of pressurized tank 12 in any suitable manner having an appropriate seal 48 disposed therebetween for preventing fluid or particle leakage therebetween. Thus, the control valve housing H is mounted with the pressurized tank 12 above the abrasive inlet 36*c*. It will be appreciated that the abrasive inlet 36*c* communicates with the interior portion (not numbered) of the pressurized tank 12 for receiving abrasive particles therein. Preferably, the pressurized tank 12 has a conically-shaped base 12*b* adjacent to and above the neck portion 12*a* for directing abrasive particles within the pressurized tank 12 thereinto neck portion 12*b* and into the abrasive inlet 36*c* within abrasive inlet member 36*m***.

An abrasive pipe sleeve **36*n* is preferably mounted with the central body member 36*i* having end portion 36*o* adapted to be disposed within side opening 36*l* of the central body member 36*i* and rigidly affixed thereto, preferably by weldments 50. Abrasive pipe sleeve 36*n* is formed having interior threads 36*p* which are adapted to receive corresponding exterior threads 36*r* formed on the exterior surface of adjusting ring 36*q* with the adjusting ring 36*q* being rotatable within the interior threads 36*p*. A suitable detent 36*s* is formed in the adjusting ring 36*q* to receive an appropriate tool (not shown) for rotating the adjusting ring 36*q* with respect to the abrasive pipe sleeve 36*n*. Locking ring 36*t* is formed having internal threads 36*u* which threadedly engage exterior threads 36*r* of the adjusting ring 36*q*. By threaded rotation of the locking ring 36*t* such that end surface 36*v* thereof engages end surface 36*w* of the abrasive pipe sleeve 36*n*, relative movement of the adjusting ring 36*q* with respect to the abrasive pipe sleeve 36*n* and locking ring 36*t*** is prevented.

The control valve assembly A of the present invention further includes a tubular abrasive flow pipe P adapted to be mounted with the discharge outlet end portion **36*b* of the housing 36. The tubular abrasive flow pipe P includes flow pipe 60 being of a substantially tubular configuration having a bore 60*a* therethrough. The flow pipe 60 has a first end 60*b* extending into the mixing chamber 36*d* of housing 36 and a second end 60*c* extending beyond the discharge outlet end portion 36*b* of the housing 36. The flow pipe 60 is adapted to be disposed within bore 36*x* formed in abrasive pipe sleeve 36*n* with seal 62 preventing any fluid migration between the exterior surface 60*d* of flow pipe 60 and the bore 36*x* of the abrasive pipe sleeve 36*n*. The flow pipe 60 has detents 60*e*, 60*f* formed on exterior portion thereof for receiving retaining rings 64, 66, respectively. The flow pipe 60 is further adapted to be disposed within bore 36*y* formed in adjusting ring 36*q* with the outside diameter of exterior surface 60*d* being slightly smaller in diameter than bore 36*y*. Counterbore 36*z* formed in adjusting ring 36*q* allows disposition of the retaining ring 66 in the counterbore 36*z* and properly positioned within detent 60*f* while detent 60*e* receives retaining ring 64. The retaining rings 64, 66 locate the adjusting ring 36*q* with respect to the flow pipe 60 while allowing relative rotation of the adjusting ring 36*q* with respect to the exterior surface 60*d* of the flow pipe 60. Rotation of the adjusting ring 36*q* in threads 36*p* results in longitudinal movement of the flow pipe 60 with respect to bore 36*x* and further regulates the extension of the first end 60*b* of flow pipe 60 into the mixing chamber 36*d* of the housing 36**.

Flow pipe 60 is further formed having exterior threads **60*g* adjacent second end 60*c* to threadedly receive abrasive hose coupling 68. The abrasive hose coupling 68 is threaded onto exterior threads 60*g* at one end thereof and is adapted to receive the tubular conduit/abrasive hose 16 adjacent the other end thereof for use in the abrasive blasting system 10**.

The control valve assembly A of the present invention further includes an abrasive control nozzle N mounted in substantial longitudinal alignment with the tubular abrasive flow pipe P with the abrasive control nozzle N being disposed within the tubular abrasive flow pipe P. The abrasive control nozzle N includes nozzle 70 having a bore **70*a* therethrough, an exterior conically-shaped end portion 70*b*, a flat annular surface 70*c*, an attachment flange 70*d*, and an abutting surface 70*e*. The exterior conically-shaped end portion 70*b* is preferably disposed within the tubular abrasive flow pipe P adjacent the similarly formed, conically-shaped end portion 60*h*. Seal means S is preferably disposed on the flat annular surface 70*c* as discussed more fully hereinbelow. Mounting ring 72 is adapted to engage attachment flange 70*d* of the nozzle 70 for securing the nozzle 70 to the mandrel 80 adjacent second end 80*b* as discussed more fully hereinbelow while further locating and securing the seal means S with the nozzle 70**.

The control valve assembly A of the present invention further includes seal means S for sealing between the first end 60*b* of flow pipe 60 and nozzle 70 when the flow pipe 60 and nozzle 70 are in the closed position as shown in FIG. 2. Preferably, the seal means S includes seal 76 having an inner bore 76*a* adapted to engage annular surface 70*c* of nozzle 70. Surface 76*b* of nozzle 76 is adapted to fit in an abutting relation with the attachment flange 70*d*. The seal 76 further includes a conical exterior surface 76*c* adapted to abut conical interior surface 72*a* of mounting ring 72. As such, when the mounting ring 72 is fastened with the nozzle 70 and the mandrel 80, the seal 76 is held in position on the annular surface 70*c* and attachment flange 70*d* of nozzle 70 by the conical interior surface 72*a* of the mounting ring 72 so engaging the conical exterior surface 76*c* of seal 76. The seal 76 may be of any suitable sealing material such as butyl rubber, leather, "Teflon", polyvinyl chloride, or any other suitable sealing material.

The control valve assembly A of the present invention further includes a mandrel 80 adapted to be movably mounted with the control valve housing H in substantial longitudinal alignment with the tubular abrasive flow pipe P. The mandrel 80 has a first end 80*a* adapted to be connected to the high pressure source (not shown) adjacent the fluid inlet end portion 36*a* of housing 36 and has a second end 80*b* extending into the mixing chamber 36*d* of housing 36. The mandrel 80 further includes a bore 80*c* extending therethrough, with the exterior surfaces of the mandrel 80 including a neck portion 80*d* adjacent first end 80*a*, a radial lip 80*e* adjacent the second end 80*b* and radial lip 80*f* substantially intermediate of first end 80*a* and second end 80*b*. Outer annular surfaces 80*g*, 80*h* of radial lips 80*e*, 80*f*, respectively, correspond to and are adapted to be disposed in tubular member 36*g* of the housing 36 for longitudinal movement therein. Exterior threads 80*i* are formed adjacent first end 80*a* for threadedly connecting the control valve assembly A of the present invention with the high pressure fluid flowing in the direction of arrow 14 having passed through metering valve 30 thereinto member 32 for connection therewith mandrel 80.

The neck portion 80*d* of mandrel 80 has an outside diameter corresponding substantially to that of opening 90 formed in end plate 36*e* of the fluid inlet end portion 36*a*. A recess 92 is formed intermediate of opening 90 in the end plate 36*e* for receiving a suitable seal 94 for allowing movement of the mandrel 80 longitudinally with respect to opening 90 adjacent neck portion 80*d* without fluid migration therebetween the neck portion 80*d* and opening 90.

The control valve assembly A of the present invention further includes moving means M for moving the abrasive control nozzle N and the tubular abrasive flow pipe P relative to each other to and from an open abrasive fluid mixing position (FIG. 2A) and from and to a closed position (FIG. 2), respectively. The moving means M includes diaphragm means D mounted with the control valve housing H and the mandrel 80 for allowing fluid pressure responsive movement of the mandrel 80 to and from the closed position from and to the open position, respectively, as discussed more fully hereinbelow.

The diaphragm means D includes a first diaphragm 96 mounted with the radial lip 80*f* and the control valve housing H. The outer portion 96*a* of the first diaphragm 96 is preferably secured with the control valve housing H therebetween end plate 36*e* and flange plate 36*f* by fasteners 38, in an abutting, fluid-tight relation. The inner portion 96*b* of the first diaphragm 96 is secured to the mandrel 80 therebetween radial lip 80*f* and mounting ring 82 by suitable fasteners 84 extending through mounting ring 82, first diaphragm 96 and thereinto radial lip 80*f*.

A closure chamber 86 is formed therebetween the first diaphragm 96 and the end plate 36*e* of fluid inlet end portion 36*a* of housing 36 within the control valve housing H. Threaded opening 88 formed in end plate 36*e* is adapted to threadedly receive fluid control line 26 which is in communication with closure chamber 86. As such, the closure chamber 86 communicates with the fluid source through fluid control line 26 such that in response to fluid moving in the direction of arrow 78 through fluid control line 26, fluid pressure in closure chamber 86 urges against first diaphragm 96 such that mandrel 80 moves from the open position (FIG. 2A) to the closed position (FIG. 2) as discussed more fully hereinbelow.

The diaphragm means D further includes a second diaphragm 98 mounted with the control valve housing H and between the second end 80*b* of the mandrel 80 and the abrasive control nozzle N. The abrasive control nozzle N is preferably mounted with the second end 80*b* of mandrel 80 in substantial longitudinal alignment with the tubular abrasive flow pipe P. Inner portion 98*a* of second diaphragm 98 is preferably disposed between the attachment flange 70*d* of nozzle 70 and second end 80*b* of mandrel 80 and secured thereto by fasteners 74 extending through mounting ring 72, attachment flange 70*d*, inner portion 98*a* of second diaphragm 98, and thereinto the mandrel 80 adjacent second end 80*b*, resulting in a fluid-tight, abutting relation therebetween. The outer portion 98*b* of the second diaphragm 98 is secured with the control valve housing H by being disposed therebetween the central body member 36*i* and outer diaphragm flange 36*h* and secured therebetween by fasteners 44 extending through outer diaphragm flange 36*h*, outer portion 98*b* of second diaphragm 98 and into central body member 36*i*, resulting in an abutting, fluid-tight relation.

In the use or operation of the control valve assembly A of the present invention as shown in FIGS. 1, 2 and 2A, the control valve assembly A is in a closed position as shown in FIG. 2. As such, the first end 60*b* of flow pipe 60 is in a sealing, abutting relation with the seal 76 of seal means S. This sealing relationship is maintained because of positive fluid pressure entering into closure chamber 86 in the direction of arrow 78 from fluid control line 26 as controlled by the metering valve 30 and remote control valve 18. The fluid pressure acting upon first diaphragm 96 urges the mandrel 80 having the nozzle 70 mounted therewith longitudinally towards the first end 60*b* of the flow pipe 60 to insure a sealable relation therebetween seal 76 and first end 60*b* of flow pipe 60. Seal 94 engaging neck portion 80*d* prevents any fluid leakage outwardly from closure chamber 86. Any fluid escaping from the closure chamber 86 into the recess 92 of opening 90 will coact with the interior portion of seal 94 to further force the seal 94 into sealing engagement with recess 92 and the neck portion 80*d* of mandrel 80 to insure a fluid-tight arrangement. It should be noted that in this closed position, the fluid pressure entering in the direction of arrow 78 into closure chamber 86 may be equal to or greater than that exerted by the pressurized abrasive particles being stored within the pressurized tank 12 under fluid pressure to be directed into abrasive inlet 36 into mixing chamber 36*d* due to the larger effective area of diaphragm 96 than that of diaphragm 98.

Actuation of remote control valve 18 of the abrasive blasting system 10 results in actuation of metering valve 30 wherein fluid pressure acting in the direction of arrow 78 (FIG. 1) is released, reversing the direction thereof outwardly in the direction of arrow 79 as shown in FIG. 2A while permitting high pressure fluid flow through bore 80*c* of mandrel 80 from metering valve 30 through flexible member 32. Reduction in pressure in the closure chamber 86 allows the fluid pressure urging the abrasive particles from pressurized tank 12 into the abrasive inlet 36*c* and mixing chamber 36*d* to urge the second diaphragm 98, mandrel 80, and nozzle 70 out of engagement with the first end 60*b* of the flow pipe 60. When the first end 60*b* of the flow pipe 60 moves out of contact with the seal 76, mixing of the abrasive from the pressurized tank 12 with high pressure fluid is permitted in an orifice 99 formed adjacent to and between the abrasive control nozzle N and the tubular abrasive flow pipe P. The abrasive flows from within the mixing chamber 36*d* into orifice 99 between conical end portion 70*b* and nozzle 70 and, preferably, a similarly shaped conical interior surface 60*h* of flow pipe 60 adjacent first end 60*b*. High pressure fluid flowing in the direction of arrow 14 enters into bore 80*c* of mandrel 80 adjacent first end 80*a*, thereafter flowing into bore 70*a* of nozzle 70 having a reduced cross-sectional area resulting in venturi-action across the nozzle 70. This venturi-action in addition to fluid pressure on the abrasive particles within mixing chamber 36*d* from pressurized tank 12 results in abrasive particles flowing through orifice 99 into flow pipe 60 adjacent position 97 where the abrasive is entrained within the high pressure fluid. The thus highly fluid-pressurized abrasive is directed through the bore 60*a* of flow pipe 60 and outwardly therefrom into a tubular conductor such as high pressure abrasive hose 16 to thereafter be discharged in the direction of arrow 22 from outlet nozzle 20 for use in abrasive blasting operations. Upon release of the remote control valve 18, positive fluid pressure is again directed in the direction of arrow 78 into fluid control line 26, then into closure chamber 86 for closing the control valve assembly A of the present invention for preventing mixing of high pressure fluid and abrasive in the closed position. It should be noted that when the control valve assembly A is in the closed position, metering valve 30 prevents the directing of high pressure fluid in the direction of arrow 14 through the bore 80*c* of mandrel 80 to effectively stop the flow of fluid and abrasive through the control valve assembly A.

The control valve assembly A of the present invention further includes clean-out means C in communication with the mixing chamber 36*d* for cleaning abrasive particles therefrom during non-blasting periods. The clean-out means C preferably includes a cleanout plug 52 having threads 52*a* to be threadedly received in threaded bottom opening 36*k* of central body member 36*i* of housing 36. Preferably, threaded opening 36*k* is in substantial longitudinal alignment with abrasive inlet 36*c*. Should abrasive particles clog within the mixing chamber 36*d*, orifice 99, between end portion 60*b* and seal 76, or in abrasive inlet 36*c*, the cleanout plug 52 need merely be removed from the central body member 36*i* of housing 36 and suitable means, such as air pressure or the like may be used to dislodge the clogging particles therefrom so that blasting operations may thereafter proceed unencumbered with such blockage. Thereafter, the cleanout plug 52 is replaced and further blasting operations may ensue without requiring disassembly of the control valve assembly A.

Figure 3A:
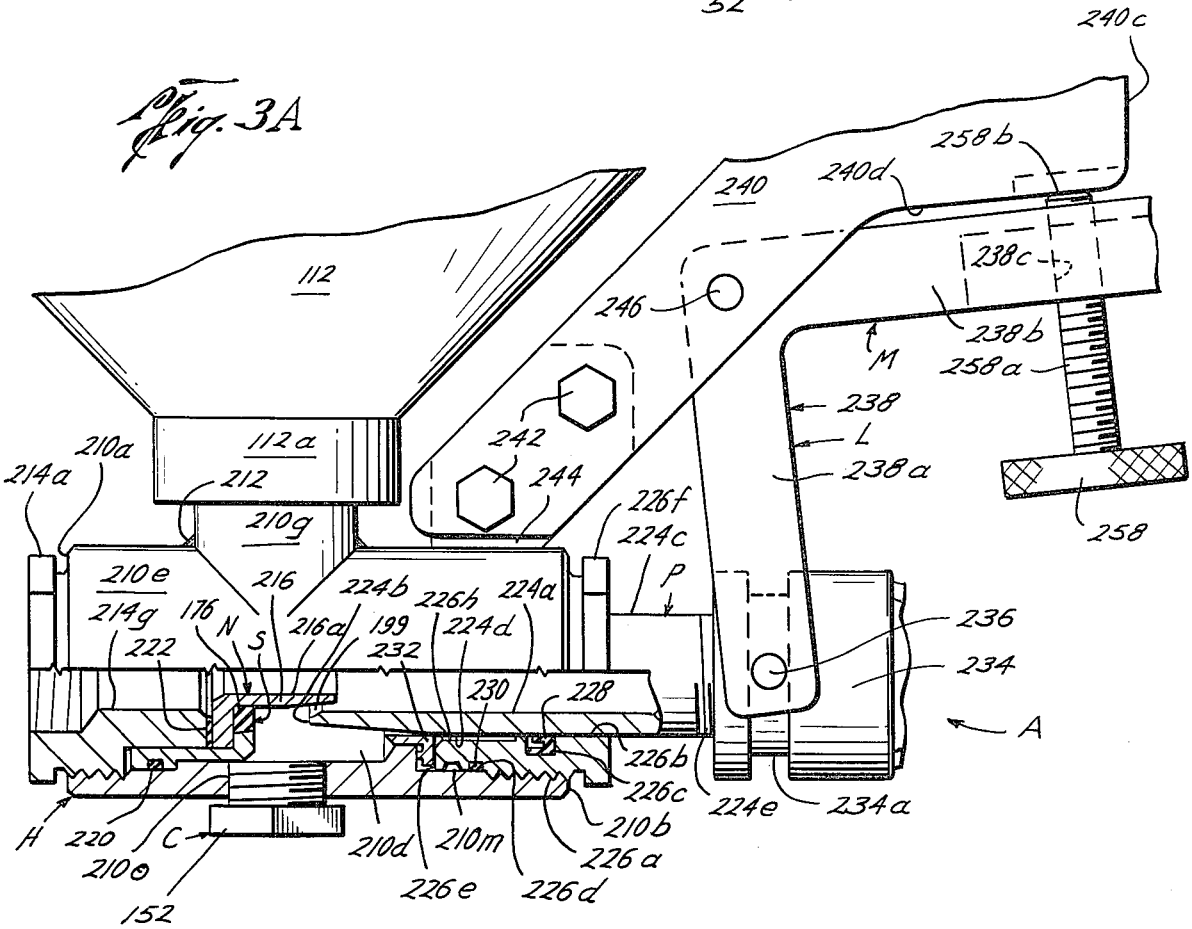
FIG. 3A is a sectional view, partly in elevation, of the control valve assembly of FIG. 3, in an open position.
Figure 3:
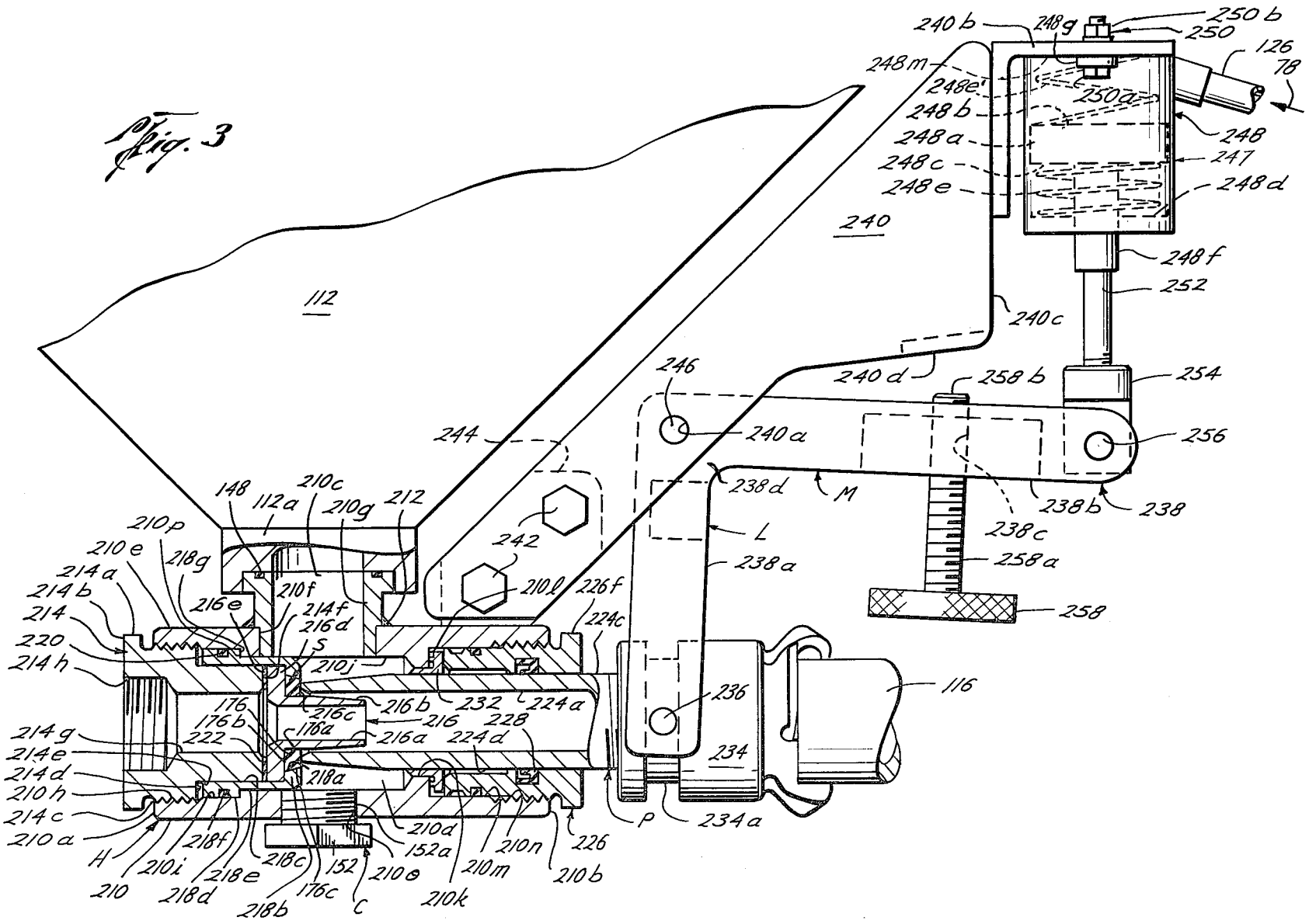
FIG. 3 is a sectional view, partly in elevation, of the second embodiment of the control valve assembly of the present invention, in a closed position.

The control valve assembly A of the present invention further includes a second embodiment as shown in FIGS. 3 and 3A. The structure that is substantially identical to the control valve assembly A as shown in FIGS. 2 and 2A will be referenced with the same numerals as used in FIGS. 2 and 2A but being preceded by the numeral "1", using the exact alpha-numeric digits thereafter. Differing structure will be signified by the use of 200–299 series numbers.

The control valve assembly A of the embodiment of FIGS. 3 and 3A includes a control valve housing H including housing 210 having a fluid inlet end portion 210*a* and a discharge outlet end portion 210*b*. An abrasive inlet 210*c* is formed between fluid inlet end portion 210*a* and discharge outlet end portion 210*b*. A mixing chamber 210*d* is formed within the housing 210 in communication with abrasive inlet 210*c*. Preferably, the housing 210 is formed having a central body member 210*e* having an opening 210*f* formed adjacent the upper portion thereof and adapted to receive abrasive inlet member 210*g* which is suitably affixed thereto by weldments 212. The abrasive inlet member 210*g* is suitably affixed to neck portion 112*a* of pressurized tank 112 having an appropriate seal 148 between the upper end of the abrasive inlet member 210*g* and the neck portion 112*a* of abrasive tank 112 to prevent any fluid leakage therebetween. The abrasive inlet 210*c* within abrasive inlet member 210*g* is in communication with the interior portion (not numbered) of the pressurized tank 112 such that abrasive particles within the pressurized tank 112 may flow into the abrasive inlet member 210*c* and thereafter into the mixing chamber 210*d*.

The housing 210 is further formed having interior threads 210*h* adjacent fluid inlet end portion 210*a*, having a stepped surface 210*i* adjacent interior threads 210*h* and further having bore 210*j* formed adjacent stepped surface 210*i*, with radial flange 210*k* adjacent bore 210*j*. Radial surface 210*l* with radial flange 210*k* abuts counterbore 210*m* adjacent discharge outlet end portion 210*b*, with interior threads 210*n* between counterbore 210*m* and the discharge outlet end portion 210*b*. Clean-out plug 152 of clean-out means C is preferably threadedly mounted with a suitable threaded opening 210*o* formed in the lower portion of the central body member 210*e*. It should be noted that preferably, the threaded opening 210*o* is longitudinally aligned with the longitudinal axis of the abrasive inlet member 210*g* to enhance proper cleanout thereof during maintenance operations.

The control valve assembly A of the present invention further includes a mandrel 214 adapted to be mounted with the fluid inlet end portion 210*a* of the housing 210. The mandrel 214 is preferably formed having a tool receiving surface 214*a* adjacent end 214*b* on the exterior surface thereof. Exterior threads 214*c* are preferably formed adjacent to tool receiving surface 214*a* and compatible with interior threads 210*h* of housing 210. Radial surface 214*d* is formed adjacent to thread 214*c* with sleeve receiving surface 214*e* abutting radial surface 214*d*. Sleeve receiving surface 214*e* extends between radial surface 214*d* and end 214*f*. Bore 214*g* extends from end 214*f* therethrough mandrel 214 further having threaded counterbore 214h formed in axial alignment with bore 214g adjacent end 214b.

The abrasive control nozzle N includes nozzle 216 adapted to be mounted with the mandrel 214 adjacent and 214f. The nozzle 216 includes a bore 216a, a preferably conically-shaped end portion 216b, a flat annular surface 216c, an attachment flange 216d, and abutting surface 216e. The bore 216a of nozzle 216 is adapted to be longitudinally aligned with the bore 214g of mandrel 214. Seal 176 of seal means S is adapted to be disposed on flat annular surface 216c of nozzle 216 with surface 176 *a* engaging same while surface 176b abuts the attachement flange 216d.

Seal means S is secured in position by sleeve 218 having conical end surface 218a for engaging conical surface 176c of seal 176. Conical end surface 218a is formed adjacent end 218b of sleeve 218. Sleeve 218 has a bore 218c, an outer annular surface 218d, and stepped annular surface 218e. Preferably, a recess 218f is formed on outer annular surface 218d and adapted to receive a seal 220 which sealably engages stepped surface 210i of housing 210. The sleeve 218 not only positions seal 176 appropriately on the nozzle 216 but further engages attachment flange 216d of nozzle 216 for securing the nozzle 216 with the mandrel 214. A seal 222 of any suitable material is disposed between attachment flange 216d of nozzle 216 and end 214f of mandrel 214 to prevent fluid leakage therebetween such surfaces and the bore 218c of sleeve 218. In assembly, mandrel 214 is threaded by exterior threads 214c into interior threads 210h of housing 210, end 214f of mandrel 214 engages seal 222 and attachment flange 216d of nozzle 216 with end 218b of sleeve 218 constraining the attachment flange 216d from movement with the sleeve 218 having shoulder 218g engaging shoulder 210p of housing 210 in an abutting relation to secure the nozzle 216 snugly between sleeve 218 and mandrel 214.

The control valve assembly A of the present invention further includes a tubular abrasive flow pipe P including flow pipe 224. The flow pipe 224 has a bore 224a, a first end 224b extending into the mixing chamber 210d, a second end 224c extending outwardly from the discharge outlet end portion 210b and an exterior surface 224d. The flow pipe 224 is adapted to be disposed within the discharge outlet end portion 210b of housing 210. The flow pipe 224 is movably disposed within the housing 210 and mounted therewith by means of seal retainer 226.

The seal retainer 226 has exterior threads 226a for engaging interior threads 210n on housing 210 and further includes a bore 226b for disposing the flow pipe 224 therein such that the external surface 224d thereof has an outside diameter slightly smaller than the bore 226b of seal retainer 226. An inner recess 226c is formed in bore 226b for receiving gasket 228 for sealably engaging the exterior surface 224c of flow pipe 224. Recess 226d is preferably formed adjacent exterior threads 226a for receiving a suitable seal 230, such as an O-ring or the like for sealably engaging counterbore 210m of housing 210. End portion 226e of seal retainer 226 is adapted to engage packing gland gasket 232 between end portion 226e and radial surface 210l and radial flange 210k of housing 210. Rotation of the seal retainer 226 by engagement of the tool receiving surfaces 226f of the seal retainer 226 with a tool (not shown) results in rotation of the seal retainer 226 within threads 210n for appropriately packing the packing gland gasket 232 in position such that the packing gland gasket 232 engages end portion 226e, radial surface 210l, radial surface 210l, radial flange 210k, and exterior surface 224c of flow pipe 224 in a sealing relation.

The flow pipe 224 has threads 224e formed adjacent second end 224c for threadedly receiving hose coupling 234. Preferably, house coupling 234 is formed having a collar 234a for receiving pin 236 as described more fully hereinbelow. Hose coupling 234 is adated to secure the abrasive hose 116 with the control valve assembly A of the present invention.

The control valve assembly A further includes moving means M for moving the abrasive control nozzle N and the tubular abrasive flow pipe P relative to one another to and from an open abrasive fluid mixing position as shown in FIG. 3A and from and to a closed position, as shown in FIG. 3, respectively. The moving means M includes lever means L that is pivotally mounted with the second end 224c of the flow pipe 224 for moving the flow pipe 224 to and from the closed position and from and to the open position, respectively. The lever means L preferably includes lever 238, preferably of a right-angular configuration having arms 238a , 238b preferably substantially perpendicular to each other. The lever 238 is preferably supported by support bracket 240 which is secured by fasteners 242 to support tab 244 mounted with the control valve housing H in any suitable fashion. The support bracket 240 may parallel the exterior surface of pressurized tank 112 and is preferably formed having a central opening 240a formed therein and adapted to receive pin 246 for pivotally mounting the lever 238 therewith adjacent arm juncture 238d. Lever arm 238a of lever 238 is preferably pinned to hose coupling 234 by pin 236.

The lever means L further includes a pneumatic cylinder 247 including pneumatic cylinder housing 248 adapted to be mounted with support bracket 240. Cylinder mount 240b secured to end 240c of support bracket 240 mounts the pneumatic cylinder housing 248 with support bracket 240 by fasteners 250, which may be of a bolt and nut configuration 250a, 250b, as shown, or any other suitable fastening device, for securing housing tabs 248g with cylinder mount 240b. The pneumatic cylinder 247 preferably includes a piston, schematically shown as 248a having an upper piston surface 248b and a lower piston surface 248c. The pneumatic cylinder 248 further includes a lower inner surface 248d such that a spring 248e may be appropriately disposed between the lower inner surface 248d and the lower piston surface 248c of piston 248c. Piston rod 248f is connected with lower piston surface 248c of piston 248a and extends outwardly therefrom pneumatic cylinder housing 248 having an adjusting rod 252 threadedly attached thereto. Clevis 254 is adapted to threadedly receive adjusting rod 252, with the clevis 254 being appropriately pinned to lever arm 238b by pin 256. Adjusting screw 258 is preferably mounted with lever arm 238b by threads 258a of adjusting screw 258 engaging threads 238c formed in arm 238b. Further, the adjusting screw 258 has an end portion 258b which is adapted to engage surface 240d of bracket 240 as described more fully hereinbelow.

In the use or operation of the control valve assembly A as shown in FIGS. 3 and 3A, fluid pressure in the direction of arrow 78 from metering valve 30 (FIG. 1) through fluid control line 126 acts upon the upper piston surface 248b of piston 248a of pneumatic cylinder 247 resulting in downward urging of piston rod 248f, adjusting and 252, and clevis 254. This downward movement acts through pins 256, 246 and 236 resulting in longitudinal movement of the flow pipe 224 such that first end 224*b* of flow pipe 224 sealably engages seal 176 of seal means S. As such, the control valve assembly A of the present invention is in a closed position wherein no mixing of abrasive and high pressure fluid occurs. Release of fluid pressure in fluid control line 126 by actuation of remote control valve 18 and thus, metering valve 30 results in removal of the fluid pressure on upper piston surface 248*b*. Spring 248*e* acts upon lower piston surface 248*c* of piston 248*a* with the piston 248*a* moving upwardly within the pneumatic cylinder housing 248. The upward movement of the piston 248*a* is translated by lever means L and pins 256, 246, 236 to the hose coupling 234 for withdrawing the flow pipe 224 from engagement with the seal means S. As such, abrasive particles under pressure from pressurized tank 112 within mixing chamber 210*d* are allowed to flow into the bore 224*a* of flow pipe 224 to mix with high pressure fluid entering the control valve assembly A as regulated by metering valve 30. The high pressure fluid flows through bore 214*g* of mandrel 214, through bore 216*a* of nozzle 216 into bore 224*a* of flow pipe 224. An orifice 199 is formed adjacent adjacent and between the end 224*b* of flow pipe 224 and the nozzle 216 of the abrasive control nozzle N. A combination of venturiaction across the nozzle 216 and the pressurized flow of abrasive particles from pressurized tank 112 results in dispersion and entrainment of the abrasive particles in the high pressure fluid within the bore 224*a* of the flow pipe to thereafter be directed outwardly through hose coupling 234 to the tubular conduit or abrasive hose 116 for use as described above. Rotation of adjusting screw 258 controls the relative size of orifice 199 available for introducing the abrasive into the high pressure fluid flow. Gaskets 228, 232 prevent any fluid-particle leakage between flow pipe 224 and the seal retainer 226 upon the sliding, longitudinal movement of the flow pipe 224 within the control valve housing H of the present invention. Upon release of the remote control valve 18, the pneumatic cylinder 147 is again pressurized for returning the control valve assembly to its closed position. It will be appreciated that the pneumatic cylinder 247 could alternatively be of a "double-acting" type having fluid responsive movement to fluid pressure acting on lower piston surface 248*c* by appropriate porting and removal of spring 248*e*. Further, the spring 248*e* may be alternatively disposed between the upper piston surface 248*b* of piston 248*a* and upper inner surface 248*m* of the pneumatic cylinder housing 248 as shown as 248*e'* for resiliently urging the tubular abrasive flow pipe P into the closed position when no fluid pressure is imposed in the pneumatic cylinder housing 248. In this instance, fluid control line 126 would necessarily communicate with the chamber between lower piston surface 248*c* and lower inner surface 248*d* of housing 248.

Figure 4:
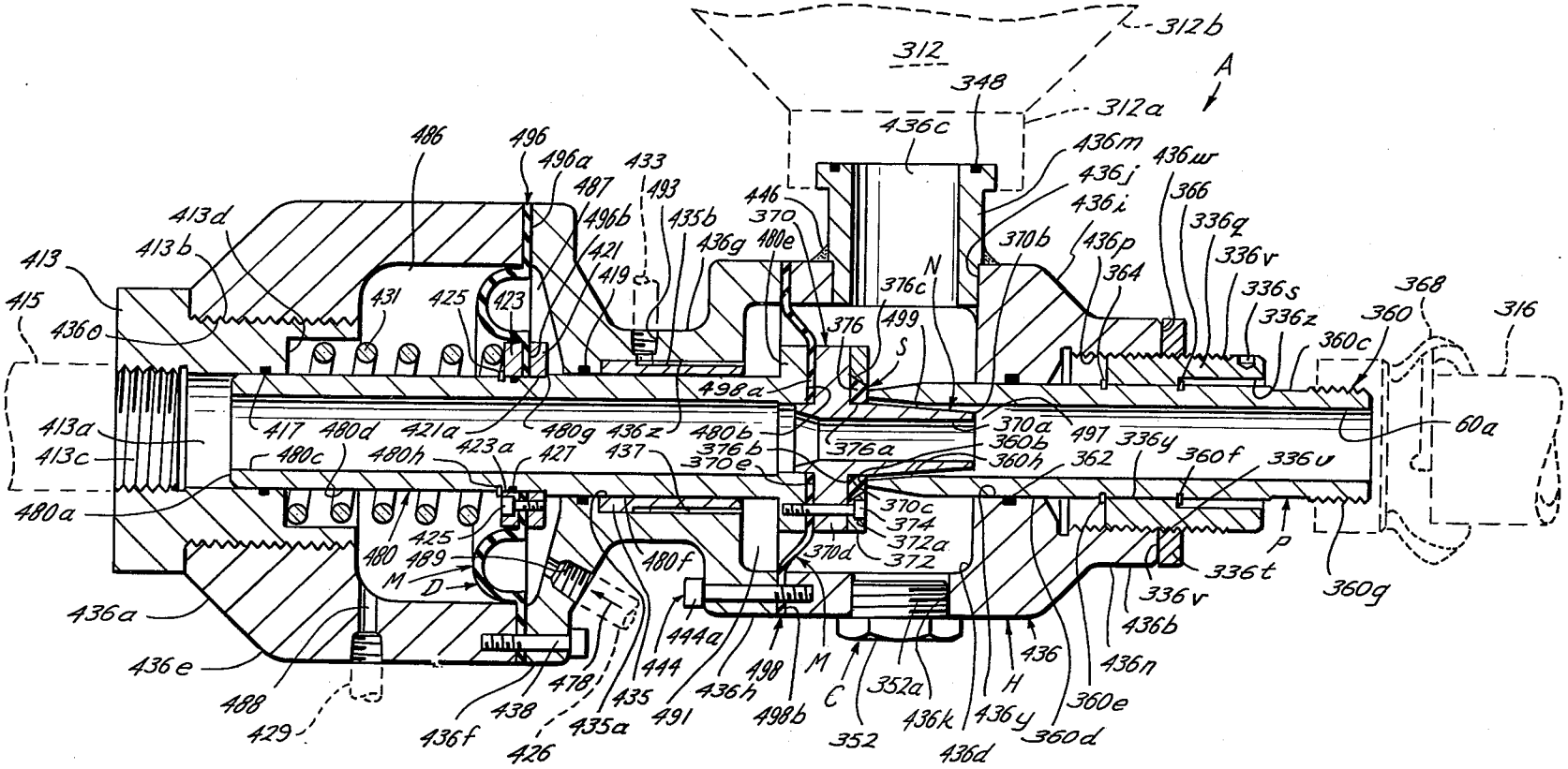
FIG. 4 is a sectional view, partly in elevation of the third embodiment of the control valve assembly of the present invention, in a closed position.

The control valve assembly A of the present invention further includes a third embodiment as shown in FIG. 4. This structure is similar in many respects to that of FIGS. 2 and 2A. That structure that is substantially identical to the control valve assembly A as shown in FIGS. 2 and 2A will be referenced with the same numerals as used in FIGS. 2 and 2A, but preceded by the numeral "3" using the exact alpha-numeric digits thereafter. Differing structure will be signified by the use of 400–499 series numbers.

As shown in FIG. 4, the control valve assembly A of the present invention includes a control valve housing H. The control valve housing H includes housing 436 having a fluid inlet end portion 436*a* and a discharge outlet end portion 436*b*. An abrasive inlet 436*c* is formed between the fluid inlet end portion 436*a* and discharge outlet end portion 436*b*. A mixing chamber 436*d* is formed within the housing 436 in communication with the abrasive inlet 436*c*.

The fluid inlet end portion 436*a* includes end plate 436*e* and flange plate 436*f*. End plate 436*e* is affixed to flange plate 436*f* by suitable fasteners 438, such as bolts, screws or the like, and the flange plate 436*f* is preferably formed having a tubular member 436*g* and outer flange 436*h* formed therewith with flange 436*h* at the end opposing the flange plate 436*f*. Preferably, flange plate 436*f*, tubular member 436*g* and flange 436*h* are formed of a one-piece construction. Flange 436*h* is affixed to central body member 436*i* by fasteners 444 such as bolts 444*a* or the like.

The central body member 436*i* is formed having the mixing chamber 436*d* therein. The central body member 436*i* has a top opening 436*j*, a bottom opening 436*k*, and a side opening 436*y*, all in communication with and adjacent to the mixing chamber 436*d*. Abrasive inlet member 436*m* is mounted with the top opening 436*j* of the central body member 436*i* by suitable weldments 446 with the abrasive inlet member 436*m* having the abrasive inlet 436*c* formed therein and communicating with the mixing chamber 436*d*. The abrasive inlet member 436*m* is adapted to be mounted with the neck portion 312*a* adjacent the lowermost end of the pressurized tank 312 in any suitable manner having an appropriate seal 348 disposed therebetween for preventing fluid or particle leakage therebetween. Thus, the control valve housing H is mounted with the pressurized tank 312 above the abrasive inlet 436*c*. The abrasive inlet 436*c* communicates with the interior portion (not numbered) of the pressurized tank 312 for receiving abrasive particles therein. The conically-shaped base 312*b* of the pressurized tank 312, adjacent to and above the neck portion 312*a*, directs abrasive particles within the pressurized tank 312 thereinto the neck portion 312*b* and into the abrasive inlet 436*c* within abrasive inlet member 436*m*.

Preferably, the central body member 436*i* is formed having an abrasive pipe sleeve 436*n* therewith, having interior threads 436*p* formed therein which are adapted to receive corresponding exterior threads 336*r* formed on the exterior surface of adjusting ring 336*q*, with the adjusting ring 336*q* being rotatable within the interior threads 436*p*. A suitable detent 336*s* is formed in the adjusting ring 336*q* to receive an appropriate tool (not shown) for rotating adjusting ring 336*q* with respect to the abrasive pipe sleeve 436*n*. Locking ring 336*t* is formed having internal threads 336*u* which threadedly engage exterior threads 336*r* of the adjusting ring 336*q*. By threaded rotation of the locking ring 336*t*, such that the end surface 336*v* thereof engages end surface 436*w* of the abrasive pipe sleeve 436*n*, relative movement of the adjusting ring 336*q* with respect to the abrasive pipe sleeve 436*n* and locking ring 336*t* is prevented.

The control valve assembly A of the present invention further includes a tubular abrasive flow pipe P adapted to be mounted with the discharge outlet end portion 436*b* of the housing 436. The tubular abrasive flow pipe P includes flow pipe 360 which is substantially identical with flow pipe 60 of FIGS. 2, 2A and described fully hereinabove. The flow pipe 360 has a bore 360*a* extending therethrough, further having a first end 360*b* extending into the mixing chamber 436*d* of the housing 436, and a second end 360*c* extending beyond the discharge outlet end portion 436*b* of the housing 436. The flow pipe 360 is adapted to be disposed within the opening 436*y* formed in the central body member 436*i* with seal 362 preventing any fluid migration between the exterior surface 360*d* of the flow pipe 360 and the opening 436*y* of the central body member 436*i*. The flow pipe 360 has detents 360*e*, 360*f* formed on the exterior surface 360 thereof for receiving retaining rings 364, 366, respectively. The flow pipe 360 is further adapted to be disposed within the bore 336*y* formed in adjusting ring 336*q* with the outside diameter of exterior surface 360*d* being slightly smaller in diameter than bore 336*y*. Counterbore 336*z* formed in adjusting ring 336*q* allows disposition of the retaining ring 366 in the counterbore 336*z* and properly positioned within detent 360*f* while detent 360*e* receives retaining ring 364. The retaining rings 364, 366 locate the adjusting ring 336*q* with respect to the flow pipe 360 while allowing relative rotation of adjusting ring 336*q* with respect to the exterior surface 360*d* of the flow pipe 360. Rotation of adjusting ring 336*q* in threads 336*p* results in longitudinal movement of the flow pipe 360 with respect to opening 336*k* and further regulates the extension of the first end 360*b* of the flow pipe 360 into the mixing chamber 436*b* of the housing 436.

Flow pipe 360 is further formed having exterior threads 360*g* adjacent second end 360*c* to threadedly receive abrasive hose coupling 368. The abrasive hose coupling 368 is threaded onto exterior threads 360*g* at one end thereof and is adapted to receive the tubular conduit abrasive hose 316 adjacent the other end thereof for use in the abrasive blasting system 10.

The control valve assembly A of the present invention further includes an abrasive control nozzle N mounted in substantial longitudinal alignment with the tubular abrasive flow pipe P with the abrasive control nozzle N being disposed within the tubular abrasive flow pipe P. The abrasive control nozzle N includes nozzle 370 having a bore 370*a* therethrough, an exterior conically-shaped end portion 370*b*, a flat annular surface 370*c*, an attachment flange 370*d*, and an abutting surface 370*e*. The exterior conically-shaped end portion 370*b* is preferably disposed within the tubular abrasive flow pipe P adjacent the similarly formed, conically-shaped end portion 360*h*. Seal means S is preferably disposed on the flat annular surface 370*c* as discussed more fully hereinbelow. Mounting ring 372 is adapted to engage attachment flange 370*d* of the nozzle 370 for securing the nozzle 370 to the mandrel 480 adjacent second end 480*d* as discussed more fully hereinbelow while further locating and securing the seal means as with the nozzle 370.

The control valve assembly A of the present invention further includes seal means S for sealing between the first end 360*b* of the flow pipe 360 and nozzle 370 when the flow pipe 360 and nozzle 370 are in a closed position as shown in FIG. 4. Preferably, the seal means S includes seal 376 having an inner bore 376*a* adapted to engage annular surface 370*c* of nozzle 370. Surface 376*b* of nozzle 376 is adapted to fit in abutting relation with the attachment flange 370*d*. The seal 376 further includes a conical, exterior surface 376*c* adapted to abut conical interior surface 372*a* of mounting ring 372. As such, when the mounting ring 372 is fastened with the nozzle 370 and mandrel 480, the seal 376 is held in position on the annular surface 370*c* and attachment flange 370*d* of nozzle 370 by the conical interior surface 372*a* of the mounting ring 372 so engaging the conical exterior surface 376*c* of seal 376. The seal 376 may be of any suitable sealing material such as butyl rubber, leather, "Teflon", polyvinyl chloride, or any other suitable sealing material.

The control valve assembly A of the present invention further includes a mandrel 480 adapted to be movably mounted with the control valve housing H in substantial longitudinal alignment with the tubular abrasive flow pipe P. The mandrel 480 has a first end 480*a* adapted to be movably disposed adjacent the fluid inlet end portion 436*a* of housing 436 and has a second end 480*b* extending into the mixing chamber 436*d* of the housing 436. The mandrel 480 further includes a bore 480*c* extending therethrough, with the exterior surfaces of the mandrel 480 including spring mounting surface 480*d* adjacent first end 480*a*, a radial lip 480*e* adjacent the second end 480*b*, engaging surface 480*f* adjacent radial lip 480*e*, with radial surface 480*g* therebetween engaging surface 480*f* and spring mounting surface 480*d*. Engaging surface 480*f* is adapted to be disposed in tubular member 436*g* of the housing 436 for longitudinal movement therein. Similarly, spring mounting surface 480*d* is adapted to be disposed in bore 413*a* of spring retainer 413. Spring retainer 413 is adapted to be mounted with the end plate 436*e* of the housing 436 in threaded opening 436*o* formed in the end plate 436*e* by suitable threads 413*b* engaging such threaded opening 436*o*. Interior threads 413*c* are formed adjacent the bore 413*a* for threadedly connecting the control valve assembly A of the present invention with the high pressure fluid flowing in the direction of arrow 14 (FIG. 1) having passed through metering valve 30 thereinto member 32 for connection therewith spring retainer 413 by fluid line 415.

Appropriate sealing members such as seals 417, 419 formed of a suitable sealing material provide for sealable movement of surfaces 480*d*, 480*f* of the mandrel 480 within bore 413*a*, tubular member 436*g*, respectively. The spring mounting portion 480*d* of mandrel 480 has an outside diameter corresponding substantially to that of bore 413*a* formed in spring retainer 413 and mounted adjacent fluid inlet end portion 436*a*. The seal 417 mounted within the bore 413*a* allows for movement of the mandrel 480 longitudinally with respect to the bore 413*a* adjacent spring mounting surface 480*d* without fluid migration therebetween the spring mounting portion 480*d* and the bore 413*a*.

The control valve assembly A of the present invention further includes moving means M for moving the abrasive control nozzle N and the tubular abrasive flow pipe P relative to each other between an open abrasive fluid mixing position and the closed position as shown in FIG. 4. The moving means M includes diaphragm means D mounted with the control valve housing H and the mandrel 480 for allowing fluid pressure responsive movement of the mandrel 480 to and from the closed position from and to the open position, respectively, as discussed more fully hereinbelow.

The diaphragm means D includes a first diaphragm 496 mounted with the control valve housing H and mandrel 480. The outer portion 496*a* of the first diaphragm 496 is preferably secured with the control valve housing H therebetween end plate 436*e* and flange plate 436*f* by fasteners 438, in an abutting, fluid-tight relation.

The inner portion 496*b* of the first diaphragm 496 is disposed between diaphragm mounting rings 421, 423 and is secured therewith by fasteners 425. The bores 421*a*, 423*a* are of slightly larger diameter than the spring mounting surface 480*d* of the mandrel 480 and adapted to be positioned thereon with diaphragm mounting ring 421 abutting radial surface 480*g* of the mandrel 480. Retaining ring 425 locates the diaphragm mounting rings 421, 423—diaphragm 496 assembly therebetween the radial surface 480*g* and the retaining ring 425, being mountable in a suitable detent 480*h* formed in the spring mounting surface 480*d*. Further, preferably a suitable seal 427 is mounted with the mandrel 480 adjacent detent 480*h* for engaging bore 423*a* of diaphragm mounting ring 423 to prevent any fluid migration therebetween.

A closure chamber 486 is formed therebetween the first diaphragm 496, the end plate 436 of fluid inlet end portion 436*a* of housing 436 and spring retainer 413 within the control valve housing H. Opening 488 formed in end plate 436*e* is adapted to threadedly receive fluid line 429 which is in communication with closure chamber 86 for venting of the same as discussed more fully hereinbelow. A spring 431 is preferably mounted in the closure chamber 486, being disposed about the spring mounting surface 480*d* and therebetween diaphragm mounting ring 423 and counterbore 413*d* formed in spring retainer 413 for resiliently urging the mandrel 480-abrasive control nozzle N-seal means S into engagement with tubular abrasive flow pipe P.

An opening chamber 487 is formed therebetween flange plate 436*f* of housing 436, first diaphragm 496, diaphragm mounting ring 421, and engaging surface 480*f* of mandrel 480. Threaded opening 489 formed in flange plate 436*f* is adapted to threadedly receive fluid control line 426 which is in communication with opening chamber 487. As such, the opening chamber 487 communicates with the fluid source through fluid control line 426 such that in response to fluid moving in the direction of arrow 478 through fluid control line 426, fluid pressure in opening chamber 487 urges against the first diaphragm 496 such that the mandrel 480 moves from the closed position of FIG. 4 to an open position (not shown).

The diaphragm means D further includes a second diaphragm 498 mounted with the control valve housing H and between the second end 480*b* of the mandrel 480 and the abrasive control nozzle N. The abrasive control nozzle N is preferably mounted with the second end 480*b* of the mandrel 480 in substantial longitudinal alignment with the tubular abrasive flow pipe P. Inner portion 498*a* of the second diaphragm 498 is preferably disposed between the attachment flange 370*d* of the nozzle 370 and the second end 480*b* of the mandrel 480 and secured thereto by fasteners 374 extending through mounting ring 372, attachment flange 370*d*, inner portion 498*a* of second diaphragm 498, and thereinto mandrel 480 adjacent second end 480*b*, resulting in a fluid-tight, abutting relation therebetween. The outer portion 498*b* of the second diaphragm 498 is secured with the control valve housing H by being disposed therebetween the central body member 436*i* and flange 436*h* and secured therebetween by fasteners 444 extending through flange 436*h*, outer portion 498*b* of second diaphragm 498 and into central body member 436*i*, resulting in an abutting fluid-tight relation.

A balancing chamber 491 is formed therebetween the second diaphragm 498, radial lip 480*e* of mandrel 480 and flange 436*h* of housing 436. Threaded opening 493 formed in tubular member 436*g* of housing 436 is adapted to threadedly receive fluid line 433 which is in communication with balancing chamber 491. Sleeve 435 is adapted to be disposed within tubular member 436*g* with the bore 435*a* of sleeve 435 being of substantially the same diameter as that of engaging surface 480*f* of the mandrel 480. The sleeve 435 is preferably disposed within the tubular member 436*g* in counterbore 436*z*, formed adjacent thereto. The sleeve 435 has a suitable reduced neck portion 435*b* having a smaller outside diameter than the inside diameter of counterbore 436*z* for providing an annular passageway 437 therebetween neck portion 435 and counterbore 436*z* for communication therebetween threaded opening 493 and balancing chamber 491.

The control valve assembly A of the present invention further includes cleanout means C in communication with the mixing chamber 436*b* for cleaning abrasive particles therefrom during non-blasting periods. Cleanout means C preferably includes a cleanout plug 352 having threads 352*a* to be threadedly received in threaded bottom opening 436*k* of the central body member 436*i* of housing 436. Preferably, threaded opening 436*k* is in substantial longitudinal alignment with abrasive inlet 436*c* to provide ease in cleaning-dislodging clogging particles therein the mixing chamber 436*d* as described fully hereinabove.

In the use or operation of the control valve assembly A of the present invention as shown in FIG. 4, the control valve assembly A is in a closed position. As such, the first end 360*b* of flow pipe 360 is in a sealing, abutting relation with the seal 76 of seal means S. This sealing relationship is maintained because of the positive, resilient urging of the spring 431 therebetween spring retainer 413 and diaphragm mounting ring 423, longitudinally towards the first end 360*b* of the flow pipe 360 to insure a sealable relation therebetween seal 376 and first end 360*b* of flow pipe 360. Actuation of the remote control valve 18 (FIG. 1) of the abrasive blasting system 10 results in actuation of metering valve 30 wherein fluid pressure acting in the direction of arrow 478 (FIG. 4) is directed into the opening chamber 487. Fluid pressure in opening chamber 487 acts upon first diaphragm 496 to result in longitudinal movement of the mandrel 480 towards the spring retainer 413 once the resilient spring force of spring 431 is overcome. Any unwanted pressure buildup in closure chamber 486 is vented outwardly therefrom through opening 488 and fluid line 429 to prevent any back pressure upon the diaphragm 496. Fluid pressure in opening chamber 487 moves the mandrel 480 having the nozzle 370 therewith out of engagement with the first end 360*b* of the flow pipe 360.

When the first end 360*b* of the flow pipe 360 moves out of contact with the seal 376, mixing of the abrasive from the pressurized tank 312 with high pressure fluid flowing through fluid line 415, and therethrough bore 480*c* of mandrel 480 is permitted in orifice 499 formed adjacent to and between the abrasive control nozzle N and the tubular abrasive flow pipe P. As discussed hereinabove, the abrasive flows from within the mixing chamber 436*d* into orifice 499 between conical end portion 370*b* of the nozzle 370 and preferably, a similarly shaped conical interior surface 360*h* of flow pipe 360 adjacent first end 360*b*. High pressure fluid flowing in the direction of arrow 14 enters into bore 480*c* of mandrel 480 adjacent first end 480*a*, thereafter flowing into bore 370*a* of nozzle 370 having a reduced cross-sectional area resulting in Venturi-action across the nozzle 370. This Venturi-action in addition to fluid pressure on the abrasive particles within the mixing chamber 436*d* from pressurized tank 312 results in abrasive particles flowing through orifice 499 into flow pipe 360 adjacent position 497, where the abrasive is entrained within the high pressure fluid.

The highly fluid-pressurized abrasive is directed through the bore 360*a* of flow pipe 360 and outwardly therefrom into a tubular conductor such as the high pressure abrasive hose 316 to thereafter be discharged in the direction of arrow 22 (FIG. 1) from outlet nozzle 20 for use in abrasive blasting operations. Upon release of the remote control valve 18, positive fluid pressure in the direction of arrow 478 into opening chamber 387 is terminated for closing control valve assembly of the present invention for preventing mixing of high pressure fluid and abrasive in the closed position. This release of pressure results in the spring 431 resiliently closing the control valve assembly A.

It should be noted that fluid line 433 is preferably mounted with the top (not shown) of the pressurized tank 312 for receiving filtered air therefrom. As is discussed hereinabove, the pressurized tank 312 is pressurized and accordingly, it is desirable that filtered air from the pressurized tank 312 be directed therefrom pressurized tank 312 through fluid line 433 therethrough passage 437 into balancing chamber 491 so that no pressure differential acts across the diaphragm 498 inasmuch as the mixing chamber 436*d* is in communication with the pressurized abrasive within the pressurized tank 312. The diaphragm 498 prevents the abrasive particles from damaging the moving surfaces of the mandrel 480. However, due to the resilient spring action of spring 431, it is desirable that no pressure differential be experienced across the diaphragm 498, hence the balancing chamber 491 and mixing chamber 436*b*, inlet chamber 436*c* and pressurized tank 312 are all at substantially the same fluid pressure levels.

It will be appreciated that the embodiment of FIG. 4 is of a "fail-safe" design inasmuch as it utilizes spring 431 to close the control valve assembly and fluid pressure applied to diaphragm 496 through opening chamber 487 to open to the control valve assembly A. This is a very desirable mode of operation inasmuch as the control valve assembly A will automatically close in the event that fluid pressure in the direction of arrow 478 is lost. Furthermore, this "fail-safe" feature may furthermore be incorporated with the embodiment of FIGS. 3, 3A by altering the spring location of spring 248*e* (FIG. 3) and fluid control line 126 by mounting the spring 148*e* therebetween upper piston surface 248*b* and upper inner surface 248*m* with control line 126 being mounted with the lower inner surface 248*d* of pneumatic cylinder 248. In such a configuration, the control valve assembly A would be maintained in its closed position due to spring 248*e* acting on upper piston surface 248*b*. The control valve assembly A will open upon fluid pressure acting in the direction of arrow 78 acting upon lower piston surface 248*c* once the resilient force of spring 248*e* is overcome to thereafter open the control valve assembly A.

Thus, the control valve assembly A of the present invention provides a new and improved control valve for use with abrasive blasting systems wherein positive on-off control may be maintained at the pressurized tank without requiring the dumping of tank pressure to deactivate the abrasive system. Further, the control valve assembly A while having multiple built-in safety features is easily maintainable and adapted to be used with a wide variety of abrasive particles for various blasting procedures.

The foregoing disclosure and description of the invention are illustrative and explanatory thereof, and various changes in the size, shape and materials as well as in the details of the illustrated construction may be made without departing from the spirit of the invention.

I claim:

1. A control valve assembly for regulating the mixing of abrasive from a pressurized tank and high pressure fluid from a high pressure fluid source to a tubular conductor for abrasive blasting operations, comprising:

a control valve housing having a fluid inlet end portion and a discharge outlet end portion;

said control valve housing having an abrasive inlet between said fluid inlet end portion and said discharge outlet end portion, the pressurized tank being mounted above said abrasive inlet of said control valve housing;

said control valve housing having a mixing chamber therein and in communication with said abrasive inlet;

a tubular abrasive flow pipe movably mounted with said discharge outlet end portion of said control valve housing, said tubular abrasive flow pipe having a first end extending into said mixing chamber and a second end extending beyond said discharge outlet end portion of said control valve housing and adapted to be connected to a tubular conductor;

an abrasive control nozzle mounted in said control valve housing for co-action with said tubular abrasive flow pipe;

moving means for moving said tubular abrasive flow pipe relative to said abrasive control nozzle to and from an open abrasive fluid mixing position from and to a closed position, respectively; and, seal means for sealing between said first end of said tubular abrasive flow pipe and said abrasive control nozzle when said tubular abrasive flow pipe and said abrasive control nozzle are in said closed position.

2. The control valve assembly of claim 1, further including:

a tubular mandrel movably mounted with said control valve housing in substantial longitudinal alignment with said tubular abrasive flow pipe, said mandrel having a first end adapted to be connected to the high pressure fluid source adjacent said fluid inlet end portion and having a second end extending into said mixing chamber, said abrasive control nozzle mounted with said second end of said mandrel.

3. The control valve assembly of claim 2, wherein said moving means includes:

diaphragm means mounted with said control valve housing and said mandrel for allowing fluid pressure responsive movement of said mandrel to and from said closed position from and to said open position, respectively.

4. The control valve assembly of claim 3, wherein:

said diaphragm means includes a first diaphragm mounted with a radial lip formed centrally about said mandrel and mounted with said control valve housing; and, a closure chamber formed between said first diaphragm and said fluid inlet end portion within said control valve housing, said closure chamber in communication with the fluid source such that in response to fluid pressure in said closure chamber, said mandrel moves from said open position to said closed position.

5. The control valve assembly of claim 3, wherein:

said diaphragm means includes a second diaphragm mounted with said control valve housing and between said second end of said mandrel and said abrasive control nozzle, said second diaphragm being in communication with and responsive to pressurized abrasive from the pressurized tank for moving said mandrel from said closed position to said open position.

6. The control valve assembly of claim 2, wherein said moving means includes:

diaphragm means mounted with said control valve housing and said mandrel for allowing fluid pressure responsive movement of said mandrel to said open position.

7. The control valve assembly of claim 6, wherein said moving means includes:

spring means mounted with said control valve housing and said mandrel for resiliently forcing said mandrel in said closed position when no fluid pressure is exerted on said diaphragm means, said spring means being adapted to be overcome by fluid pressure acting on said diaphragm means for movement of said mandrel to said open position.

8. The control valve assembly of claim 1, wherein said moving means includes:

lever means pivotally mounted with said second end of said tubular abrasive flow pipe for moving said tubular abrasive flow pipe to and from said closed position and from and to said open position, respectively.

9. The control valve assembly of claim 8, wherein:

said seal means is mounted with said abrasive control nozzle; and said first end of said tubular abrasive flow pipe moves out of contact with said seal means permitting mixing of the abrasive from the pressurized tank with the high pressure fluid in an orifice formed adjacent to and between said abrasive control nozzle and said tubular abrasive flow pipe, the high pressure abrasive being directed through said tubular abrasive flow pipe to the tubular conductor for use in abrasive blasting operations.

10. The control valve assembly of claim 8, wherein said lever means includes:

a support bracket mounted with said control valve housing;

pneumatic cylinder mounted with said support bracket; and a lever arm pivotally mounted with said pneumatic cylinder, said support bracket, and said second end of said tubular abrasive flow pipe for moving said tubular abrasive flow pipe to and from said open position and from and to said closed position, respectively.

11. The control valve assembly of claim 10, further including:

spring means mounted with said lever means for resiliently urging said tubular abrasive flow pipe into said closed position when no fluid pressure is imposed in said pneumatic cylinder.

12. The control valve assembly of claim 1, wherein:

said seal means is mounted with said abrasive control nozzle and is movable out of contact with said first end of said tubular abrasive flow pipe permitting mixing of the abrasive from the pressurized tank with the high pressure fluid in an orifice formed adjacent to and between said abrasive control nozzle and said first end of said tubular abrasive flow pipe, the high pressure abrasive being directed through said tubular abrasive flow pipe to the tubular conductor for use in abrasive blasting operations.

13. The control valve assembly of claim 1, further including:

cleanout means in communication with said mixing chamber for cleaning abrasive particles therefrom during non-blasting periods.

14. The control valve assembly of claim 1, wherein:

the exterior surface of said abrasive control nozzle and the interior surface of said tubular abrasive flow pipe adjacent said first end thereof are of a substantially conical configuration with said abrasive control nozzle disposed within said tubular abrasive flow pipe when in said closed position.

* * * * *